United States Patent [19]

Honey et al.

[11] Patent Number: 4,810,334

[45] Date of Patent: Mar. 7, 1989

[54] OVERLAY COATING

[75] Inventors: Francis J. Honey, Burnham on Sea; Eric C. Kedward, Banwell; John Foster, Weston-super-Mare, all of England

[73] Assignee: BAJ Limited, England

[21] Appl. No.: 173,237

[22] Filed: Mar. 24, 1988

[30] Foreign Application Priority Data

Mar. 24, 1987 [GB] United Kingdom ..... 8706951

[51] Int. Cl.[4] ..... C25D 5/10; C25D 5/50; C25D 15/00

[52] U.S. Cl. ..... 204/16; 204/37.1; 204/38.5

[58] Field of Search ..... 204/16, 37.1, 38.5

[56] References Cited

U.S. PATENT DOCUMENTS 4,305,792 12/1981 Kedward ..... 204/16

*Primary Examiner*—T. M. Tufariello

*Attorney, Agent, or Firm*—Wallenstein Wagner Hattis & Strampel, Ltd.

[57] ABSTRACT

A method of producing an overlay coating on a substrate such as a turbine blade which comprises: (1) plating a protection layer comprising a metal matrix $M_1$ containing particles of $CrAlM_2$, (2) plating an anchoring layer comprising a metal layer containing larger particles, and (3) spray coating a thermal barrier of a refractory material.

10 Claims, No Drawings

OVERLAY COATING

BACKGROUND OF THE INVENTION

This invention relates to the provision of overlay coatings incorporating thermal barriers on substrates. Such overlay coatings are employed on components which are subjected to high temperature environments, particularly where corrosion and/or erosion is likely to occur; the primary, but not necessarily sole, application of such coatings is to parts of gas turbine engines, particularly gas turbine combustion can ware, stator and rotor blades and guide vanes.

It has been proposed to produce an overlay coating by first spray coating on to a suitably prepared substrate surface a protection layer of MCrAlY (where M is a suitable metal such as nickel or cobalt or nickel and cobalt) using a plasma deposition process, then spray coating an anchoring coat of a metal by a flame deposition process which produces in the deposit substantially coarser particles than those in the protection layer, and then spray coating a thermal barrier of a refractory material by a plasma deposition process.

While this procedure is, in general, satisfactory there are certain aspects of it which are not ideal. For example, the flame spraying of complex and re-entrant surfaces can be difficult and expensive.

SUMMARY OF INVENTION

According to the present invention an overlay coating on a substrate is provided by forming a protection layer by composite electrolytic deposition of a metal matrix $M_1$ containing particles of $CrAlM_2$ where $M_1$ is Ni or Co or both and $M_2$ is one or more of Y, Si, Ti, Hf, Ta or a rare earth element, forming an anchoring coat by composite electrolytic deposition of a metal matrix containing particles of a larger size than the particles of $CrAlM_2$ of the protection layer, and then spray coating a thermal barrier of a refractory material by a plasma deposition process.

The invention thus differs from that which has previously been proposed in that the protection layer and the anchoring coat are both electrically plated rather than being flame sprayed.

The production of an $M_1CrAlM_2$ layer by plating has already been proposed in British Patent No. 2,167,446 where the object is to produce a coating which will, at some stage, be modified by heat treatment and that specification stresses that there should be close control of the particle size, the broadly preferred size requirement being that at least 99% by weight of the particles in the as-deposited coating are below 25 μm or at least 95% are between 3.0 and 13.6 μm. The specification mentions that electrodeposition produces a coating which has a very desirable surface finish. Plating is a process which is well known to produce coatings with smooth, even shiny, surfaces and the incorporation in the deposited matrix of particles of this size still leads to relatively smooth surfaces. A thermal barrier cannot be applied directly to a spray coated MCrAlY coating with sufficient adhesion because the sprayed MCrAlY coating is insufficiently rough. A spray coated anchoring coat using coarser particles has been necessary. Consequently it would be thought that composite plating would be quite useless in providing a base for a thermal barrier. Most surprisingly, however, it has been found that a plated $M_1CrAlM_2$ coat followed by a plated anchoring coat with larger particles provides a most satisfactory basis on to which a thermal barrier may be applied by spray coating, with completely satisfactory adhesion between the layers. Thus the plated anchoring coat is used to produce a rough keying surface, something which is quite contrary to the normally accepted property of a plated coat which is one of smoothness.

The preferred constituents of the anchoring coat are the same as or similar to those of the protection layer since, in addition to providing an anchorage function, this coat will be subjected to similar operating conditions to those for which the underlying protection layer is provided.

The preferred constituents of and processes for applying the protection layer are those set out in the aforementioned British Patent No. 2,167,446 and for further details of apparatus and processes that may be employed reference may be made to U.S. Pat. No. 4,305,792. The same apparatus and processes may be used for applying the anchoring coat.

DETAILED DESCRIPTION

The invention may be carried into practice in various ways but the provision of one particular overlay on a gas turbine blade will now be described by way of example.

The blade was first given a preparation treatment suitable for plating and in one example it was immersed in a cyanide cleaner for two minutes followed by a water rinse, etched by immersion for 30 seconds in a ferric chloride etch followed by a water rinse, and given a nickel strike by placing in a nickel bath for 3 minutes at a current density of 3.5 amps per square decimetre. The blade was then secured in the plating barrel described in U.S. Pat. No. 4,305,792 and connected to a cathode contact. Using the techniques described in the said United States Patent the blade was given a coating to a thickness of between 0.076 and 0.127 mm of CoNiCrAlY, the bath containing a CoNi plating solution and the particles were of CrAlY containing 60 parts by weight of Cr, 40 parts Al and 1.7 parts Y. The particle size distribution was a maximum of 5% by weight below 5 μm, between 10 and 15% by weight below 10 μm and between 35 and 55% by weight below 20 μm. An alternative size distribution would be a maximum of 7.7% by weight below 5 μm, 56% below 10 μm, 94% below 20 μm and 99% below 30 μm.

The blade carrying the protection layer was removed from the apparatus and washed and was then positioned in the apparatus described in British patent application No. 2182055 published May 7th, 1987 containing a similar cobalt plating solution and with the apparatus charged with CrAlY particles having the same composition as those used for the protection layer but with a different size distribution as set out below. Should a delay occur in transferring from the initial $M_1CrAlY$ coat to the second key coat process step, the component surfaces can be reactivated by immersion in the ferric chloride etch and a nickel strike similar to the initial pretreatment. The particle size distribution is such that there is not more than 1% of the powder with a size greater than 150 μm and not more than 15% with a particle size less than 38 μm. Plating proceeded to produce an anchoring coat with a thickness of between 0.025 and 0.15 mm.

The blade was then removed and washed. The coatings were then vacuum heat treated to effect bonding of the superficial powder to the rest of the deposit. For example, the blade could be treated at 1115° C. for 2 hours or at a temperature within the range 1050° to 1100° C. for 2 hours or within the range 900° to 1200° C. for a maximum of 2 hours at 1200° C. or a minimum of ¼ hour at 900° C. The thermal barrier was then sprayed onto the anchoring coat by a plasma flame deposition process. The coat consisted essentially of an 8% yttria stabilized zirconia having a chemical composition by weight of between 7 and 9% $Y_2O_3$, maxima of 1.5% $SiO_2$, 0.5% CaO, 0.3% MgO, 0.4% $Fe_2O_3$, 0.2% $Al_2O_3$ and 0.2% $TiO_2$, and the balance being $ZrO_2$. The particle size distribution was such that there was a maximum of 10% with a size greater than 74 μm, between 65 and 100% was above 44 μm and a maximum of 25% was below 44 μm. Instead of the vacuum heat treatment being carried out after the application of the anchoring coat, it could be carried out in the same manner after application of the thermal barrier.

As an alternative to the process described in U.S. Pat. No. 4,305,792, the protective layer may be applied by the same apparatus and processes as are proposed above for applying the anchoring coat and described in the aforesaid British patent application publication No. 2182055.

During thermal cycling tests on paddle shaped specimens coated on one side by the process in accordance with the invention and described above and moved in and out of a flame to give a surface temperature rise to 1050° C. in 2 minutes, and a fall in 2 minutes, the specimens satisfactorily withstood 1000 thermal cycles where the typical commercial acceptance level is 500 thermal cycles.

We claim:

1. A process of producing an overlay coating on a substrate which comprises the steps of:

(1) forming on said substrate a protection layer by composite electrolytic deposition of a metal matrix $M_1$ containing particles of $CrAlM_2$ where $M_1$ is Ni or Co or both and $M_2$ is one or more of Y, Si, Ti, Hf, Ta or a rare earth element, (2) forming on said protection layer an anchoring coat by composite electrolytic deposition of a metal matrix containing particles of a larger size than the particles of $CrAlM_2$ of the protection layer, and then (3) spray coating on said protection layer a thermal barrier of a refractory material by a plasma deposition process.

2. The process of claim 1 in which the particles of said anchoring coat are of the same composition as, but of larger particle size than, the particles of said protection layer.

3. The process of claim 1 in which the size distribution of the particles in said protection layer is a maximum of 5% by weight below 5 μm, between 10 and 15% by weight below 10 μm and between 35 and 55% by weight below 20 μm.

4. The process of claim 3 in which said protection layer has a thickness of from 0.076 to 0.127 mm.

5. The process of claim 1 in which the size distribution of the particles in said protection layer is a maximum of 7.7% by weight below 5 μm, 56% below 10 μm, 94% below 20 μm and 99% below 30 μm.

6. The process of claim 3 in which the size distribution of the particles in said anchoring coat is a maximum of 1% by weight above 150 μm and a maximum of 5% by weight below 38 μm.

7. The process of claim 6 in which the said anchoring coat has a thickness of from 0.025 to 0.15 mm.

8. The process in claim 1 wherein said thermal barrier consists essentially of yttria stabilized zirconia.

9. The process in claim 8 wherein the particle size distribution in the thermal barrier is a maximum of 10% by weight greater than 74 μm, between 65% and 100% above 44 μm, and not more than 25% below 44 μm.

10. A process of producing an overlay coating on a gas turbine engine component which comprises the steps of:

(1) preparing the surface of said component for electroplating, (2) electroplating on said surface to a depth of from 0.076 to 0.127 mm a protection layer of CoNi containing particles of CrAlY containing 60 parts by weight of Cr, 40 parts Al and 1.7 parts Y, (3) electroplating on said protection layer to a depth of from 0.025 to 0.15 mm an anchoring coat of a cobalt-containing metal matrix containing CrAlY particles having a greater particle size than those of the protection layer, (4) spray coating on said protection layer a thermal barrier of a refractory material by a plasma deposition process, and (5) after step 3, heat treating said component.

* * * * *